US006773822B2

(12) United States Patent
Capps

(10) Patent No.: US 6,773,822 B2
(45) **Date of Patent: *Aug. 10, 2004**

(54) ANTIFUNGAL GYPSUM BOARD

(75) Inventor: Charles Capps, Little Rock, AR (US)

(73) Assignee: Temple-Inland Forest Products Corporation, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/210,680

(22) Filed: Aug. 1, 2002

(65) Prior Publication Data

US 2003/0035981 A1 Feb. 20, 2003

Related U.S. Application Data

(60) Provisional application No. 60/310,442, filed on Aug. 3, 2001.

(51) Int. Cl.[7] ..... B32B 29/00; A01N 33/02; A01N 25/34

(52) U.S. Cl. ..... 428/537.7; 106/15.05; 106/18.32; 106/18.35; 106/778; 106/780; 106/781; 156/39; 156/44; 162/160; 162/161; 424/413; 424/414; 428/70; 428/537.5; 428/907

(58) Field of Search ..... 106/15.05, 18.32, 106/18.35, 778, 780, 781; 156/39, 44; 162/160, 161; 424/413, 414; 428/70, 537.5, 537.7, 907

(56) References Cited

U.S. PATENT DOCUMENTS 3,918,981 A * 11/1975 Long ..... 106/16
3,998,944 A * 12/1976 Long ..... 424/413
4,323,565 A * 4/1982 Hasegawa et al. ..... 514/223.8
5,084,096 A * 1/1992 Stovicek ..... 106/18.21
5,110,684 A * 5/1992 Cooper ..... 428/447
6,387,172 B1 * 5/2002 Yu et al. ..... 106/680
6,481,171 B2 * 11/2002 Yu et al. ..... 52/443

FOREIGN PATENT DOCUMENTS

| | | |
|---|---|---|
| JP | 54-132622 | * 10/1979 |
| JP | 59121173 | 7/1984 |
| JP | 4-69301 | * 3/1992 |
| JP | 8-34655 | * 2/1996 |
| JP | 10017351 | 1/1998 |
| WO | 02/22976 | * 3/2002 |

OTHER PUBLICATIONS

International Search Report, PCT/US02/24765, Nov. 19, 2002, WIPO.
International Search Report, PCT/US02/29447, Jun. 4, 2003, WIPO.
Rabasco, et al.; *"Polymer Emulsion Preservation Using Cationic Compounds"*; U.S. patent application Publication 2002/0099113. Jul. 25, 2002.

* cited by examiner

*Primary Examiner*—Anthony J. Green
(74) *Attorney, Agent, or Firm*—Conley Rose, P.C.; Rodney B. Carroll

(57) ABSTRACT

A novel gypsum board having antifungal properties is disclosed. The board comprises a gypsum core, front and back paper facings and an antifungal agent effective at inhibiting fungal growth. A preferred antifungal agent is cetyl pyridinium chloride. The antifungal agent can be present in the gypsum core and/or on one or both of the paper facings. In addition, the antifungal agent may be encapsulated in a material that releases the antifungal agent over time and/or upon exposure to moisture. Also disclosed are methods for preparing the aforementioned antifungal gypsum board.

30 Claims, No Drawings

ANTIFUNGAL GYPSUM BOARD

CROSS-REFERENCE TO RELATED APPLICATIONS

The present application claims the benefit of U.S. provisional application Serial No. 60/310,442, filed Aug. 3, 2001, and entitled "Antifungal Gypsum Board and Method for Making Same," which is incorporated herein by reference.

STATEMENT REGARDING FEDERALLY SPONSORED RESEARCH OR DEVELOPMENT

Not Applicable.

BACKGROUND OF THE INVENTION

1. Technical Field of the Invention

The present invention relates generally to gypsum board and methods for making gypsum board. More specifically, the present invention relates to gypsum board possessing antifungal properties and methods of making same.

2. Description of Related Art

Gypsum board, which is sold as wall board and drywall, is a common building material used in various applications including interior walls, partitions and ceiling construction. Commercial gypsum board products are popular for a variety of reasons. They are durable, economical and fire-retardant. In addition, these boards provide excellent compressive-strength properties and a relatively low density. Finally, they are easily decorated and are therefore attractive as surfacing materials, especially for interior construction.

One fundamental limitation of traditional gypsum board products is their susceptibility to moisture absorption in damp environments. To minimize this problem, gypsum board is normally used in interior construction where exposure to moisture is limited. Unfortunately, products used in interior construction sometimes encounter water due to seepage, leaky roofs or pipes, flooding, condensation, and the like, arising out of construction defects or other events unrelated to the manufacture of the gypsum board. Thus, a number of mechanisms result in the exposure of gypsum board products to moisture. Once exposed to moisture, traditional gypsum board products are susceptible to fungal growth.

There is an ongoing need for gypsum board products that offer reduced susceptibility to fungal growth without compromising their beneficial properties. In addition, there is an ongoing need for commercially-viable manufacturing methods for such products. The present invention solves these problems by using an antifungal agent that effectively inhibits fungal growth, is compatible with gypsum board materials, and can be incorporated into a cost-effective and commercially-viable manufacturing process.

BRIEF SUMMARY OF PREFERRED EMBODIMENTS

The preferred embodiments of the present invention include a novel gypsum board comprising an effective amount of an antifungal agent such that fungal growth on or in the board is inhibited. According to a preferred embodiment of the present invention, the antifungal agent is cetyl pyridinium chloride (CPC), a quaternary ammonium compound. Preferably, the gypsum board comprises from about 0.01 to about 1.5 weight percent CPC based on the dry weight of the gypsum in the board. More preferably, the gypsum board comprises between about 0.5 and about 1.0 weight percent CPC based on the dry weight of the gypsum in the board. According to some preferred embodiments, the CPC is encapsulated in an encapsulator so that it is released over time and/or upon exposure to moisture.

The preferred embodiments of the present invention also include methods of preparing the novel gypsum board described above. According to some preferred embodiments, CPC is incorporated onto or into the gypsum core by premixing CPC with the water, premixing the CPC with the gypsum powder, admixing the CPC with both the water and gypsum powder prior to or in the slurry mixer, and/or adding CPC to a mixed gypsum slurry via a secondary or in-line mixer. According to other preferred embodiments, a CPC solution is sprayed onto the front and/or back paper facings. According to other preferred embodiments, CPC is incorporated into the front and/or back paper facings as they are manufactured.

DETAILED DESCRIPTION OF PREFERRED EMBODIMENTS

The present invention derives from the discovery that an effective antifungal agent exhibits compatibility with gypsum board without diminishing the qualities of the gypsum board. Preferably, the mechanical properties of the gypsum board such as density, breakstrengths, bond strength, core end and edge hardness, modulus of flexibility and the like are substantially unchanged by the addition of the antifungal agent. By substantially unchanged, a given mechanical property preferably remains within the parameters of governing standards—e.g., ASTM standards. Consequently, the novel gypsum board product achieves the structural, economic and other benefits of gypsum board while also offering significant resistance to fungal growth. The novel gypsum board product can be prepared according to methods that are cost-effective and commercially viable.

The preferred embodiments of the present invention include a novel gypsum board comprised of a gypsum core, paper surfacing bonded to both sides of the core, and an antifungal agent. Any material suitable as a gypsum core is within the scope of the present invention. Therefore, without limiting the scope of the invention, the preferred embodiments comprise a gypsum core comprised of gypsum powder, water and optionally foam, pulp, starch and/or set controlling agents. Typically, the gypsum core is sandwiched between two sheets that are commonly referred to as the front and back paper facings. The front paper facing is generally a light-colored, smoothly textured paper designed to face into the interior of the building. The back paper facing, in contrast, is typically a darker, less smoothly-textured paper designed not to be seen. Any material suitable as a front and/or back paper facing is within the scope of the present invention. Therefore, without limiting the scope of the invention, the preferred embodiments comprise front and back paper facings comprised of a cellulosic material.

The preferred embodiments of the present invention also employ an antifungal agent, as used herein meaning and including all agents, materials, and combinations thereof providing antimicrobial activity. Preferred antimicrobial agents are those of the type and in an amount effective for inhibiting the growth and/or formation of microbes such as bacteria and/or fungi. Any known antifungal agent compatible with gypsum board composition and manufacturing processes and providing the desired biocidal, antifungal, antimycogen, antibacterial, and/or like activity in the gypsum board may be employed with the present invention. As will be readily apparent to one of skill in the art, a variety of antifungal agents are known including, for example, chlorhexidine, alexidine, cetyl pyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban. A preferred class of antifungal agents is quaternary ammonium compounds, including but not limited to the following compounds:

Fluoride:

Tetra-n-butylammonium Fluoride

Tetraethylammonium Fluoride

Chloride:

Acetylcholine Chloride (3-Acrylamidopropyl)trimethylammonium Chloride

Benzalkonium Chloride

Benzethonium Chloride

Benzoylcholine Chloride

Benzylcetyldimethylammonium Chloride

N-Benzylcinchonidinium Chloride

N-Benzylcinchoninium Chloride

Benzyldimethylphenylammonium Chloride

Benzyldimethylstearylammonium Chloride

N-Benzylquinidinium Chloride

N-Benzylquininium Chloride

Benzyltri-n-butylammonium Chloride

Benzyltriethylammonium Chloride

Benzyltrimethylammonium Chloride

Carbamylcholine Chloride

DL-Camitine Hydrochloride

Chlorocholine Chloride (3-Chloro-2-hydroxy-n-propyl)trimethylammonium Chloride

Choline Chloride n-Decyltrimethylammonium Chloride

Diallyldimethylammonium Chloride

Dichloromethylenedimethyliminium Chloride

Dimethyldistearylammonium Chloride n-Dodecyltrimethylammonium Chloride

Girard's Reagent T n-Hexadecyltrimethylammonium Chloride

Hexamethonium Chloride

Lauroylcholine Chloride

Methacholine Chloride

Methacroylcholine Chloride (2-Methoxyethoxymethyl)triethylammonium Chloride

β-Methylcholine Chloride

Methyltriethylammonium Chloride

Myristoylcholine Chloride n-Octyltrimethylammonium Chloride

Phenyltriethylammonium Chloride

Phenyltrimethylammonium Chloride

Phosphocholine Chloride Calcium Salt

Phosphocholine Chloride Sodium Salt

Succinylcholine Chloride

Tetra-n-amylammonium Chloride

Tetra-n-butylammonium Chloride

Tetradecyldimethylbenzylammonium Chloride n-Tetradecyltrimethylammonium Chloride Tetraethylammonium Chloride Tetramethylammonium Chloride Trimethyl[2,3-(dioleyloxy)propyl]ammonium Chloride Trimethylstearylammonium Chloride Trioctylmethylammonium Chloride Tri-n-octylmethylammonium Chloride Bromide:

Acetylcholine Bromide

Benzoylcholine Bromide

Benzyltri-n-butylammonium Bromide

Benzyltriethylammonium Bromide

Bromocholine Bromide

Cetyldimethylethylammonium Bromide

Choline Bromide

Decamethonium Bromide n-Decyltrimethylammonium Bromide

Didecyldimethylammonium Bromide

Dilauryldimethylammonium Bromide

Dimethyldimyristylammonium Bromide

Dimethyldioctylammonium Bromide

Dimethyldipalmitylammonium Bromide

Dimethyldistearylammonium Bromide n-Dodecyltrimethylammonium Bromide (Ferrocenylmethyl)dodecyldimethylammonium Bromide (Ferrocenylmethyl)trimethylammonium Bromide n-Hexadecyltrimethylammonium Bromide Hexamethonium Bromide Hexyldimethyloctylammonium Bromide n-Hexyltrimethylammonium Bromide Methacholine Bromide Neostigmine Bromide n-Octyltrimethylammonium Bromide Phenyltrimethylammonium Bromide Stearyltrimethylammonium Bromide Tetra-n-amylammonium Bromide Tetra-n-butylammonium Bromide Tetra-n-decylammonium Bromide n-Tetradecyltrimethylammonium Bromide Tetraethylammonium Bromide Tetra-n-heptylammonium Bromide Tetra-n-hexylammonium Bromide Tetramethylammonium Bromide Tetra-n-octylammonium Bromide Tetra-n-propylammonium Bromide 3-(Trifluoromethyl)phenyltrimethylammonium Bromide Trimethylvinylammonium Bromide Valethamate Bromide Iodide:

Acetylcholine Iodide

Acetylthiocholine Iodide

Benzoylcholine Iodide

Benzoylthiocholine Iodide

Benzyltriethylammonium Iodide n-Butyrylcholine Iodide n-Butyrylthiocholine Iodide Decamethonium Iodide N,N-Dimethylmethyleneammonium Iodide Ethyltrimethylammonium Iodide
Ethyltri-n-propylammonium Iodide
(Ferrocenylmethyl)trimethylammonium Iodide
(2-Hydroxyethyl)triethylammonium Iodide
β-Methylcholine Iodide
O-β-Naphthyloxycarbonylcholine Iodide
Phenyltriethylammonium Iodide
Phenyltrimethylammonium Iodide
Tetra-n-amylammonium Iodide
Tetra-n-butylammonium Iodide
Tetraethylammonium Iodide
Tetra-n-heptylammonium Iodide
Tetra-n-hexylammonium Iodide
Tetramethylammonium Iodide
Tetra-n-octylammonium Iodide
Tetra-n-propylammonium Iodide
3-(Trifluoromethyl)phenyltrimethylammonium Iodide
Hydroxide:
Benzyltriethylammonium Hydroxide
Benzyltrimethylammonium Hydroxide
Choline
n-Hexadecyltrimethylammonium Hydroxide
Phenyltrimethylammonium Hydroxide
Sphingomyelin
Tetra-n-butylammonium Hydroxide
Tetra-n-decylammonium Hydroxide
Tetraethylammonium Hydroxide
Tetra-n-hexylammonium Hydroxide
Tetramethylammonium Hydroxide
Tetra-n-octylammonium Hydroxide
Tetra-n-propylammonium Hydroxide
3-(Trifluoromethyl)phenyltrimethylammonium Hydroxide
Others:
Acetylcholine Perchlorate
Benzyltrimethylammonium Dichloroiodate
Benzyltrimethylammonium Tetrachloroiodate
Benzyltrimethylammonium Tribromide
Betaine, Anhydrous
Betaine Hydrochloride
Bis(tetra-n-butylammonium) Dichromate
Bis(tetra-n-butylammonium) Tetracyanodiphenoquinodimethanide
L-Carnitine
3-[(3-Cholamidopropyl)dimethylammonio]-1-propanesulfonate
Denatonium Benzoate
n-Dodecyldimethyl(3-sulfopropyl)ammonium Hydroxide, Inner Salt
N-Fluoro-N'-(chloromethyl)triethylenediamine Bis(tetrafluoroborate)
n-Hexadecyltrimethylammonium Hexafluorophosphate
n-Hexadecyltrimethylammonium Perchlorate
n-Hexadecyltrimethylammonium Tetrafluoroborate
(Methoxycarbonylsulfamoyl)triethylammonium Hydroxide, Inner Salt
Neostigmine Methyl Sulfate
n-Octadecyldimethyl(3-sulfopropyl)ammonium Hydroxide, Inner Salt
Phenyltrimethylammonium Tribromide
Propionylcholine p-Toluenesulfonate
Tetra-n-butylammonium Azide
Tetra-n-butylammonium Bifluoride
Tetra-n-butylammonium Borohydride
Tetra-n-butylammonium Bromodiiodide
Tetra-n-butylammonium Dibromoaurate
Tetra-n-butylammonium Dibromochloride
Tetra-n-butylammonium Dibromoiodide
Tetra-n-butylammonium Dichloroaurate
Tetra-n-butylammonium Dichlorobromide
Tetra-n-butylammonium Difluorotriphenylsilicate
Tetra-n-butylammonium Difluorotriphenylstannate
Tetra-n-butylammonium Dihydrogentrifluoride
Tetra-n-butylammonium Diiodoaurate
Tetra-n-butylammonium Hexafluorophosphate
Tetra-n-butylammonium Hydrogensulfate [for Ion-Pair Chromatography]
Tetra-n-butylammonium Hydrogensulfate
Tetra-n-butylammonium Perchlorate
Tetra-n-butylammonium Perrhenate
Tetra-n-butylammonium Phosphate
Tetra-n-butylammonium Salicylate
Tetra-n-butylammonium Tetrafluoroborate
Tetra-n-butylammonium Tetraphenylborate
Tetra-n-butylammonium Thiocyanate
Tetra-n-butylammonium Tribromide
Tetra-n-butylammonium Triiodide
Tetraethylammonium Borohydride
Tetraethylammonium Perchlorate
Tetraethylammonium Tetrafluoroborate
Tetraethylammonium p-Toluenesulfonate
Tetraethylammonium Trifluoromethanesulfonate
Tetramethylammonium Acetate
Tetramethylammonium Borohydride
Tetramethylammonium Hexafluorophosphate
Tetramethylammonium Hydrogensulfate
Tetramethylammonium Perchlorate
Tetramethylammonium Sulfate
Tetramethylammonium Tetrafluoroborate
Tetramethylammonium p-Toluenesulfonate
Tetramethylammonium Triacetoxyborohydride
Tetra-n-propylammonium Perruthenate
Trifluoromethanesulfonic Acid Tetra-n-butylammonium Salt Without limiting the scope of the present invention, the preferred embodiments employ cetyl pyridinium chloride (CPC) as an antifungal agent. The preferred embodiments are only exemplary: references herein to antifungal agents in general and CPC in particular are not intended to limit the scope of the invention.

Cetyl pyridinium chloride—also known as CPC or n-hexadecyl pyridinium chloride—is a cationic surfactant comprised of a hydrophilic quaternary ammonium moiety and a hydrophobic alkane moiety.

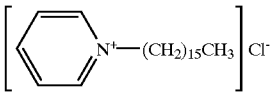

Cetyl Pyridinium Chloride (CPC)

CPC is commonly believed to possess biocidal activity due to its ability to bind readily to the negatively-charged cell walls of various microbes and to impact membrane integrity and function. It is a potent antifungal, antimycogen, and antibacterial chemical. CPC is commonly available in a powder form as a monohydrate manufactured by Zeeland/Cambrex and available from Johnson Matthey Catalog Company Inc. of Ward Hill, Mass., among others.

The preferred embodiments of the present invention employ an amount of CPC effective at inhibiting fungal, bacterial, and the like growth in or on the gypsum board. Preferably, the amount of CPC in and/or on the gypsum board is between about 0.01 and about 1.5 weight percent of the dry weight of the gypsum in the board. More preferably, the amount of CPC present in and/or on the gypsum board is between about 0.5 and about 1.0 weight percent of the dry weight of the gypsum in the board.

According to some preferred embodiments, the CPC is primarily present in the gypsum core. According to other preferred embodiments, the CPC is primarily located on one or both of the front and back paper facings, and more preferably on the outer surface of the front and back paper facings. According to yet other preferred embodiments, the CPC is primarily located in one or both of the front and back paper facings.

The present invention includes a novel method for the production of gypsum board comprising the addition of an antifungal agent during gypsum board manufacturing. The antifungal agent is added during manufacturing in an amount that yields an effective amount of the antifungal agent in and/or on the board such that fungal, bacterial, and the like formation and/or growth in and/or on the board is inhibited. Preferably, the finished gypsum board product comprises an amount of antifungal agent equal to from about 0.01 to about 1.5 weight percent of the dry weight of the gypsum in the board. More preferably, the finished gypsum board product comprises an amount of antifungal agent equal to from about 0.5 to about 1.0 weight percent of the dry weight of the gypsum in the board.

The gypsum board production process typically commences with the mining and transportation of gypsum rock. Once mined, the gypsum rock is crushed and ground into a fine powder. Alternatively, gypsum powder can be created synthetically. This powder is then subjected to a calcining process in which moisture is removed by heating. The novel gypsum board of the present invention may be prepared by any method capable of incorporating effective quantities of an agent having effective antifungal, antibacterial, and/or like activity into or onto the gypsum board product. Therefore, without limiting the scope of the present invention, the preferred embodiments of the present invention comprise mixing gypsum powder with water to form a gypsum slurry. Optionally, one or more of foam, pulp, starch and/or set controlling agents may be added to the slurry.

The preferred embodiments of the present invention comprise a gypsum board manufacturing process in which the slurry is deposited between two unwinding rolls of absorbent paper on a conveyor belt. Conveyor belts useful in gypsum board processing typically reach lengths of from about 200 to about 1000 feet. This belt may be operated at a speed of from about 50 to about 200 feet per minute and typically at about 110 feet per minute. This process results in a continuous sandwich of gypsum core between the two paper layers or facings. Thus, the forming gypsum board is cast as a sheet having a three-layer structure: a gypsum core having front and back paper facings. The sandwich then passes through a forming station that establishes the width and thickness of the gypsum board. As the gypsum board moves along the belt line, the slurry reverts to a solid gypsum matrix. As the gypsum core molds and hardens, it becomes firmly bonded to the outer paper layers. Once formed, the continuous board is cut to a desired length and passed through dryers to remove excess moisture.

The preferred embodiments of the present invention also comprise the addition of the antifungal agent during the gypsum board manufacturing process. The antifungal agent may be added by any method capable of incorporating effective quantities of such agent into or onto the gypsum board product. Therefore, without limiting the scope of the present invention, the preferred embodiments of the present invention comprise adding the antifungal agent into and/or onto the gypsum core and/or by depositing the antifungal agent into and/or onto the front and/or back paper facings.

The antifungal agent may be added to the gypsum slurry in any way capable of incorporating effective quantities of such agent into the gypsum core. Methods for adding CPC in solution form, powder form, or both during formation of the gypsum slurry include, but are not limited to, premixing CPC with the water, premixing the CPC with the gypsum powder, admixing the CPC with both the water and gypsum powder prior to or in the slurry mixer, or adding CPC to a mixed gypsum slurry via a secondary or in-line mixer. In a preferred embodiment, dry CPC powder is added (via screw feeder) to dry gypsum powder prior to mixing with water to form the slurry. In another preferred embodiment, a CPC solution is co-metered with water to a slurry mixer and mixed with gypsum powder therein. The CPC solution preferably comprises from about 5 to about 20 weight percent CPC based on the total weight of the solution, provided however that the concentration and/or addition rate of the CPC solution can be adjusted to match the manufacturing conditions (such as line speed, in linear feet per minute) and product specifications (such as desired concentration of CPC in the final board product, board thickness, etc.). The amount of CPC and addition rate thereof is adjusted to achieve an effective amount of CPC in the gypsum board for inhibiting fungal, bacterial, and the like formation and growth thereon, as discussed previously.

In another preferred embodiment, the CPC solution is sprayed onto the front and/or back paper facings, which may occur at one or more points in the manufacturing process. For example, the CPC solution can be sprayed onto the paper facings prior to or as they are unrolled to form the sheets, after the sheets have been formed, before and/or after drying the sheets, and/or after the sheets have been cut into boards. Furthermore, the CPC may be sprayed onto the inner surface, the outer surface, or both of the front and/or back paper facings. Preferably, the CPC solution for spraying comprises from about 5 to about 20 weight percent CPC based on the total weight of the solution. In another embodiment, the CPC may be added to one or both of the paper facings during manufacture of the paper facings. Adding CPC to the front and/or back paper facing (by either spraying or during manufacture of the paper) may be in addition to or as a substitute for adding CPC to the gypsum core of the board as described above. Thus, gypsum boards may have the following configurations: CPC treated core and untreated facings; untreated core and one or both CPC treated facings; and CPC treated core and one or both CPC treated facings.

Antifungal agents such as CPC frequently exhibit some toxicity to humans and animals. Consequently, minimizing human and animal exposure to CPC and other antifungal agents is desirable. Furthermore, the gypsum board should maintain its antifungal efficacy over an extended period of time. To accomplish these results, the preferred embodiments of the present invention include gypsum board products specifically formulated to release an active antifungal agent slowly over time or upon becoming wet such that the antifungal properties and activity of the board are maintained at an effective level over time. The preferred embodiments also include methods for making same. For example, a time-release antifungal agent may comprise an active antifungal agent combined with additional materials such as polymer binders or encapsulators to achieve the desired release profile of the active antifungal ingredient from the board over time or upon wetting.

In a preferred embodiment, the active antifungal agent is CPC and the encapsulator is J5MS Methocel hydroxypropyl methylcellulose, available from the Dow Chemical Company. Alternatively, an active ingredient such as CPC may be physically adhered within the gypsum core (for example, encapsulated by calcium within the gypsum core) or on/in the paper facings such that the CPC is released upon wetting of the gypsum core and/or paper facings. Methods for encapsulating active materials to achieve controlled release over time and/or upon wetting are well known and any such methods and processes are within the scope of the present invention.

EXAMPLE

A manufacturing trial was conducted at the gypsum board plant in Fletcher, Okla. to produce first and second sets of 0.5 inch thick sample gypsum boards comprising about 0.5 and about 1.0 weight percent CPC, respectively, based on the dry weight of the gypsum in the board. The board manufacturing line was run at a speed of 255 linear feet per minute, and separate 5 minute trials were conducted for each set of sample boards. For each five minute trial, the total water in the gypsum slurry was 1133 pounds per thousand square feet per minute of run time (lbs/MSF/min), for a total of 5665 lbs and the total dry gypsum powder was 1300 lbs/MSF/min of run time, for a total of 6500 lbs. For the 0.5% CPC board, 0.005×6500=32.5 lbs of CPC was added to the slurry as a 15 weight percent CPC solution, based on total weight of the solution. For the 1.0% CPC board, 0.01×6500=65.0 lbs of CPC was added to the slurry as a 15 weight percent CPC solution, based on total weight of the solution. A total of about 5000 square feet of each set of boards was produced.

Testing has indicated that CPC-treated gypsum board can effectively suppress bacterial and fungal growth. It is currently believed that appropriately treated gypsum board will exhibit broad-based resistance to a wide variety of microbes.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications and publications cited herein are hereby incorporated herein by reference, to the extent that they provide exemplary, procedural or other details supplementary to those set forth herein.

What is claimed is:

1. A gypsum board comprising an antifungal agent wherein the antifungal agent is a controlled release antifungal agent;

wherein the controlled release antifungal agent comprises an active antifungal agent and one or more encapsulator or binder materials; and wherein the controlled release antifungal agent is encapsulated by calcium within a gypsum core.

2. A gypsum board comprising an antifungal agent wherein the antifungal agent is selected from the group consisting of chlorhexidine, alexidine, cetyl pyridinium chloride, benzallconium chloride, benzethonium chloride, cetalkonium chloride, cetrimide, cetrimonium bromide, glycidyl trimethylammonium chloride, stearalkonium chloride, hexetidine, triclosan and triclocarban.

3. A gypsum board comprising an antifungal agent wherein the antifungal agent comprises cetyl pyridinium chloride.

4. The gypsum board of claim 3 wherein the cetyl pyridinium chloride is present in an amount equal to between about 0.01 and about 1.5 weight percent of the dry gypsum in the antifungal gypsum board.

5. The gypsum board of claim 3 wherein the cetyl pyridinium chloride is present in an amount equal to between about 0.5 and about 1.0 weight percent of the dry gypsum in the antifungal gypsum board.

6. The gypsum board of claim 3 wherein the gypsum board comprises a gypsum core and the cetyl pyridinium chloride is present primarily in the gypsum core.

7. The gypsum board of claim 3 wherein the gypsum board comprises front and/or back paper facings and the cetyl pyridinium chloride is present primarily in and/or on the front and/or back paper facings.

8. The gypsum board of claim 3 wherein the gypsum board comprises a gypsum core and front and/or back paper facings and the cetyl pyridinium chloride is present both in and/or on the gypsum core and in and/or on the front and/or back paper facings.

9. The gypsum board of claim 3 wherein at least a portion of the cetyl pyridinium chloride is encapsulated in an encapsulator such that it is released over time, upon exposure to moisture, or both.

10. The gypsum board of claim 9 wherein the encapsulator comprises hydroxypropyl methylcellulose.

11. A method for manufacturing a gypsum board comprising:

facing a gypsum core with paper facings and adding an antifungal agent to the board or a component thereof, wherein the antifungal agent is a controlled release antifungal agent; and encapsulating or binding the antifungal agent such that the antifungal agent is released over time, upon exposure to moisture, or both, wherein the antifungal agent is encapsulated or bound by calcium with the gypsum core.

12. A method for manufacturing a gypsum board comprising facing a gypsum core with paper facings and adding an antifungal agent to the board or a component thereof wherein the antifungal agent is selected from the group consisting of chlorhexidine, alexidine, cetyl pyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban.

13. A method for manufacturing a gypsum board comprising facing a gypsum core with paper facings and adding an antifungal agent to the board or a component thereof wherein the antifungal agent comprises cetyl pyridinium chloride.

14. The method of claim 13 wherein the cetyl pyridinium chloride is present in an amount equal to between about 0.01 and about 1.5 weight percent of the dry gypsum in the gypsum board.

15. The method of claim 13 wherein the cetyl pyridinium chloride is present in an amount equal to between about 0.5 and about 1.0 weight percent of the dry gypsum in the gypsum board.

16. The method of claim 13 wherein the cetyl pyridinium chloride is premixed with water prior to forming a gypsum slurry.

17. The method of claim 13 wherein the cetyl pyridinium chloride is premixed with the gypsum powder prior to forming a gypsum slurry.

18. The method of claim 17 wherein the cetyl pyridinium chloride is in the form of a dry powder.

19. The method of claim 13 wherein the cetyl pyridinium chloride is admixed with water and gypsum powder prior to or during mixing in a slurry mixer.

20. The method of claim 13 wherein the cetyl pyridinium chloride is an aqueous solution that is co-metered with water to a slurry mixer and mixed with gypsum powder therein.

21. The method of claim 20 wherein the cetyl pyridinium chloride in the aqueous solution is present at a concentration of between about 5 and about 20 weight percent.

22. The method of claim 13 wherein the cetyl pyridinium chloride is added to a mixed gypsum slurry via a secondary or in-line mixer.

23. The method of claim 13 wherein the cetyl pyridinium chloride is encapsulated in an encapsulator so that it is released over time, upon exposure to moisture, or both.

24. The method of claim 23 wherein the encapsulator comprises hydroxypropyl methylcellulose.

25. A process for manufacturing gypsum board comprising:

facing a gypsum core with paper facings and adding an antifungal agent to a paper to be used as a front or back paper facing in the gypsum board, wherein the antifungal agent is selected from a the group consisting of chlorhexidine, alexidine, cetyl pyridinium chloride, benzalkonium chloride, benzethonium chloride, cetalkonium chloride, cetrimide, cetrimonium bromide, glycidyl trimethylammonium chloride, stearalkonium chloride, hexetidine, triclosan and triclocarban.

26. A process for manufacturing gypsum board comprising:

facing a gypsum core with paper facings and adding an antifungal agent to a paper to be used as a front or back paper facing in the gypsum board, wherein the antifungal agent comprises cetyl pyridinium chloride.

27. The process of claim 26 wherein the cetyl pyridinium chloride is added during manufacture of the paper.

28. The process of claim 26 wherein the antifungal agent is sprayed onto the paper.

29. A gypsum board comprising an antifungal agent wherein the antifungal agent is a nonorganosilicon, nonpolymeric quaternary ammonium compound.

30. A gypsum board comprising an antifungal agent selected from the group consisting of:

Tetra-n-butylammonium Fluoride,
Tetraethylammonium Fluoride,
Acetylcholine Chloride,
(3-Acrylamidopropyl)trimethylammonium Chloride,
Benzalkonium Chloride,
Benzethonium Chloride,
Benzoylcholine Chloride,
Benzylcetyldimethylammonium Chloride,
N-Benzylcinchonidinium Chloride,
N-Benzylcinchoninium Chloride,
Benzyldimethylphenylammonium Chloride,
Benzyldimethylstearylammonium Chloride,
N-Benzylquinidinium Chloride,
N-Benzylquininium Chloride,
Benzyltri-n-butylammonium Chloride,
Benzyltriethylammonium Chloride,
Benzyltrimethylammonium Chloride,
Carbamylcholine Chloride,
DL-Carnitine Hydrochloride,
Chlorocholine Chloride,
(3-Chloro-2-hydroxy-n-propyl)trimethylammonium Chloride,
Choline Chloride,
n-Decyltrimethylammonium Chloride,
Diallyldimethylammonium Chloride,
Dichloromethylenedimethyliminium Chloride,
Dimethyldistearylammonium Chloride,
n-Dodecyltrimethylammonium Chloride,
Girard's Reagent T,
n-Hexadecyltrimethylammonium Chloride,
Hexamethonium Chloride,
Lauroylcholine Chloride,
Methacholine Chloride,
Methacroylcholine Chloride,
(2-Methoxyethoxymethyl)triethylammonium Chloride,
β-Methylcholine Chloride,
Methyltriethylammonium Chloride,
Myristoylcholine Chloride,
n-Octyltrimethylammonium Chloride,
Phenyltriethylammonium Chloride,
Phenyltrimethylammonium Chloride,
Phosphocholine Chloride Calcium Salt,
Phosphocholine Chloride Sodium Salt,
Succinylcholine Chloride,
Tetra-n-amylammonium Chloride,
Tetra-n-butylammonium Chloride,
Tetradecyldimethylbenzylammonium Chloride, n-Tetradecyltrimethylammonium Chloride,
Tetraethylammonium Chloride,
Tetramethylammonium Chloride,
Trimethyl[2,3-(dioleyloxy)propyl]ammonium Chloride,
Trimethylstearylammonium Chloride,
Trioctylmethylammonium Chloride,
Tri-n-octylmethylammonium Chloride,
Acetylcholine Bromide,
Benzoylcholine Bromide,
Benzyltri-n-butylammonium Bromide,
Benzyltriethylammonium Bromide,
Bromocholine Bromide,
Cetyldimethylethylammonium Bromide,
Choline Bromide,
Decamethonium Bromide,
n-Decyltrimethylammonium Bromide,
Didecyldimethylammonium Bromide,
Dilauryldimethylammonium Bromide,
Dimethyldimyristylammonium Bromide,
Dimethyldioctylammonium Bromide,
Dimethyldipalmitylammonium Bromide,
Dimethyldistearylammonium Bromide,
n-Dodecyltrimethylammonium Bromide,
(Ferrocenylmethyl)dodecyldimethylammonium Bromide,
(Ferrocenylmethyl)trimethylammonium Bromide,
n-Hexadecyltrimethylammonium Bromide,
Hexamethonium Bromide,
Hexyldimethyloctylammonium Bromide,
n-Hexyltrimethylammonium Bromide,
Methacholine Bromide,
Neostigmine Bromide,
n-Octyltrimethylammonium Bromide,
Phenyltrimethylammonium Bromide,
Stearyltrimethylammonium Bromide,
Tetra-n-amylammonium Bromide,
Tetra-n-butylammonium Bromide,
Tetra-n-decylammonium Bromide,
n-Tetradecyltrimethylammonium Bromide,
Tetraethylammonium Bromide,
Tetra-n-heptylammonium Bromide,
Tetra-n-hexylammonium Bromide,
Tetramethylammonium Bromide,
Tetra-n-octylammonium Bromide,
Tetra-n-propylammonium Bromide,
3-(Trifluoromethyl)phenyltrimethylammonium Bromide,
Trimethylvinylammonium Bromide,
Valethamate Bromide,
Acetylcholine Iodide,
Acetylthiocholine Iodide,
Benzoylcholine Iodide,
Benzoylthiocholine Iodide,
Benzyltriethylammonium Iodide,
n-Butyrylcholine Iodide,
n-Butyrylthiocholine Iodide,
Decamethonium Iodide,
N,N-Dimethylmethyleneammonium Iodide,
Ethyltrimethylammonium Iodide,
Ethyltri-n-propylammonium Iodide,
(Ferrocenylmethyl)trimethylammonium Iodide,
(2-Hydroxyethyl)triethylammonium Iodide,
β-Methylcholine Iodide,
O-β-Naphthyloxycarbonylcholine Iodide,
Phenyltriethylammonium Iodide,
Phenyltrimethylammonium Iodide,
Tetra-n-amylammonium Iodide,
Tetra-n-butylammonium Iodide,
Tetraethylammonium Iodide,
Tetra-n-heptylammonium Iodide,
Tetra-n-hexylammonium Iodide,
Tetramethylammonium Iodide,
Tetra-n-octylammonium Iodide,
Tetra-n-propylammonium Iodide,
3-(Trifluoromethyl)phenyltrimethylammonium Iodide,
Benzyltriethylammonium Hydroxide,
Benzyltrimethylammonium Hydroxide,
Choline,
n-Hexadecyltrimethylammonium Hydroxide,
Phenyltrimethylammonium Hydroxide,
Sphingomyelin,
Tetra-n-butylammonium Hydroxide,
Tetra-n-decylammonium Hydroxide,
Tetraethylammonium Hydroxide,
Tetra-n-hexylammonium Hydroxide,
Tetramethylammonium Hydroxide,
Tetra-n-octylammonium Hydroxide,
Tetra-n-propylammonium Hydroxide,
3-(Trifluoromethyl)phenyltrimethylammonium Hydroxide,
Acetylcholine Perchlorate,
Benzyltrimethylammonium Dichloroiodate,
Benzyltrimethylammonium Tetrachloroiodate,
Benzyltrimethylammonium Tribromide,
Betaine, Anhydrous,
Betaine Hydrochloride,
Bis(tetra-n-butylammonium) Dichromate,
Bis(tetra-n-butylammonium) Tetracyanodiphenoquinodimethanide,
L-Carnitine,
3-[(3-Cholamidopropyl)dimethylammonio]-1-propanesulfonate,
Denatonium Benzoate,
n-Dodecyldimethyl(3-sulfopropyl)ammonium Hydroxide, Inner Salt,
N-Fluoro-N'-(chloromethyl)triethylenediamine Bis (tetrafluoroborate),
n-Hexadecyltrimethylammonium Hexafluorophosphate,
n-Hexadecyltrimethylammonium Perchlorate,
n-Hexadecyltrimethylammonium Tetrafluoroborate,
(Methoxycarbonylsulfamoyl)triethylammonium Hydroxide, Inner Salt,
Neostigmine Methyl Sulfate,
n-Octadecyldimethyl(3-sulfopropyl)ammonium Hydroxide, Inner Salt,
Phenyltrimethylammonium Tribromide, Propionylcholine p-Toluenesulfonate,
Tetra-n-butylammonium Azide,
Tetra-n-butylammonium Bifluoride,
Tetra-n-butylammonium Borohydride,
Tetra-n-butylammonium Bromodiiodide,
Tetra-n-butylammonium Dibromoaurate,
Tetra-n-butylammonium Dibromochloride,
Tetra-n-butylammonium Dibromoiodide,
Tetra-n-butylammonium Dichloroaurate,
Tetra-n-butylammonium Dichlorobromide,
Tetra-n-butylammonium Difluorotriphenylsilicate,
Tetra-n-butylammonium Difluorotriphenylstannate,
Tetra-n-butylammonium Dihydrogentrifluoride,
Tetra-n-butylammonium Diiodoaurate,
Tetra-n-butylammonium Hexafluorophosphate,
Tetra-n-butylammonium Hydrogensulfate,
Tetra-n-butylammonium Perchlorate,
Tetra-n-butylammonium Perrhenate,
Tetra-n-butylammonium Phosphate,
Tetra-n-butylammonium Salicylate,
Tetra-n-butylammonium Tetrafluoroborate,
Tetra-n-butylammonium Tetraphenylborate,
Tetra-n-butylammonium Thiocyanate,
Tetra-n-butylammonium Tribromide,
Tetra-n-butylammonium Triiodide,
Tetraethylammonium Borohydride,
Tetraethylammonium Perchlorate,
Tetraethylammonium Tetrafluoroborate,
Tetraethylammonium p-Toluenesulfonate,
Tetraethylammonium Trifluoromethanesulfonate,
Tetramethylammonium Acetate,
Tetramethylammonium Borohydride,
Tetramethylammonium Hexafluorophosphate,
Tetramethylammonium Hydrogensulfate,
Tetramethylammonium Perchlorate,
Tetramethylammonium Sulfate,
Tetramethylammonium Tetrafluoroborate,
Tetramethylammonium p-Toluenesulfonate,
Tetramethylammonium Triacetoxyborohydride,
Tetra-n-propylammonium Perruthenate,
Trifluoromethanesulfonic Acid Tetra-n-butylammonium Salt,
and combinations thereof.

* * * * *

UNITED STATES PATENT AND TRADEMARK OFFICE

CERTIFICATE OF CORRECTION

PATENT NO. : 6,773,822 B2
DATED : August 10, 2004
INVENTOR(S) : Charles Capps

It is certified that error appears in the above-identified patent and that said Letters Patent is hereby corrected as shown below:

Column 3,
Line 29, replace “DL-Camitine” with -- DL-Carnitine --.

Column 10,
Line 27, replace “benzallconium” with -- benzalkonium --.

Signed and Sealed this

First Day of February, 2005

JON W. DUDAS
*Director of the United States Patent and Trademark Office*